United States Patent [19]

Simmerman et al.

[11] Patent Number: 4,887,727

[45] Date of Patent: Dec. 19, 1989

[54] GARMENT HANGER CADDY

[75] Inventors: Richard H. Simmerman, Palatine; Gregg E. Wiederer, Wheeling, both of Ill.

[73] Assignee: Hanger-Tight Company, Wheeling, Ill.

[21] Appl. No.: 245,764

[22] Filed: Sep. 16, 1988

[51] Int. Cl.[4] ..... A47F 5/00

[52] U.S. Cl. ..... 211/124; 211/7

[58] Field of Search ..... 211/124, 4, 7, 8; 206/279

[56] References Cited

U.S. PATENT DOCUMENTS

| | | | |
|---|---|---|---|
| 1,375,611 | 4/1921 | Schoell | 211/7 |
| 1,464,311 | 8/1923 | Eriksen | 211/124 |
| 1,728,919 | 9/1929 | Batts . | |
| 2,068,451 | 1/1937 | Elmore | 211/124 |
| 2,256,188 | 9/1941 | Berren | 211/124 |
| 2,276,569 | 3/1942 | Fried | 206/7 |
| 2,606,667 | 8/1952 | Hornick | 211/124 |
| 2,631,338 | 3/1953 | Peters et al. | 20/16 |
| 2,858,995 | 11/1958 | Sarro | 211/123 X |
| 2,868,390 | 1/1959 | McCrone | 211/124 |
| 2,980,260 | 4/1961 | Richer | 211/124 |
| 3,021,958 | 2/1962 | Winkler | 211/124 |
| 3,306,465 | 2/1967 | Brennan | 211/124 |
| 3,419,154 | 12/1968 | Shapiro et al. | 211/7 |
| 3,495,720 | 2/1970 | Mann, Jr. et al. | 214/1 |
| 3,498,650 | 3/1970 | Strange | 287/53 |
| 3,505,961 | 4/1970 | McElroy | 104/110 |
| 3,561,365 | 2/1971 | Rooklyn | 104/127 |
| 3,572,251 | 3/1971 | Johnson | 104/89 |
| 3,610,423 | 10/1971 | Parillo | 211/7 |
| 3,827,366 | 8/1974 | Pamer | 104/89 |
| 3,868,906 | 3/1975 | Cameron | 104/89 |
| 4,037,728 | 7/1977 | Cameron | 211/7 X |
| 4,079,840 | 3/1978 | Usner | 211/124 |
| 4,340,145 | 7/1982 | Cameron | 211/124 |
| 4,753,355 | 6/1988 | Hall et al. | 211/105.1 |

FOREIGN PATENT DOCUMENTS

| | | |
|---|---|---|
| 176150 | 2/1953 | Austria . |

*Primary Examiner*—Robert W. Gibson, Jr.

*Attorney, Agent, or Firm*—Willian Brinks Olds Hofer Gilson & Lione

[57] ABSTRACT

A garment hanger caddy includes a stiff tubular member and a relatively stiff retainer strip secured to the tubular member by a pair of latching members. Each latching member includes an embossed rigde on a central portion of one part thereof positioned to make the latching member stiffer at its central portion than at either end. The latching members can be positioned conventionally with their actuating axes parallel to the longitudinal axis of the caddy, or in a rotated position in which the actuating axes are transverse to the longitudinal axis.

20 Claims, 2 Drawing Sheets

FIG. 1
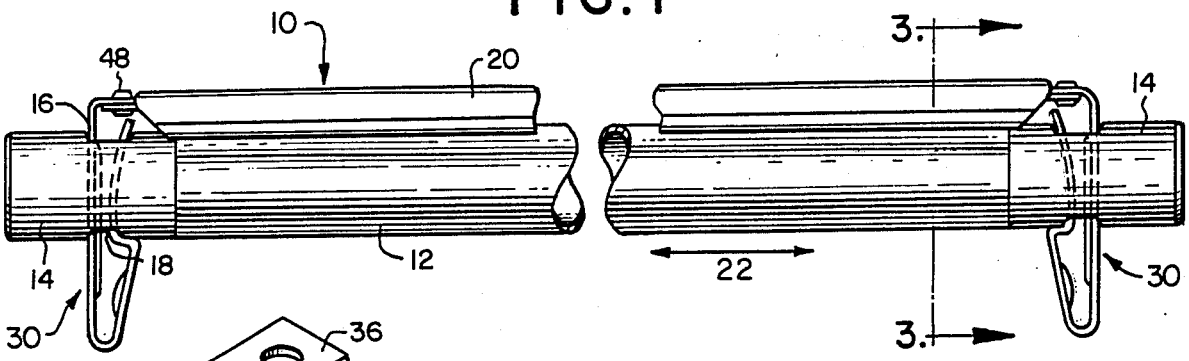
FIG. 2
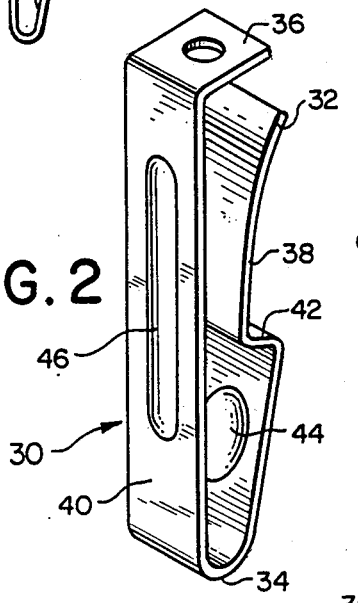
FIG. 3
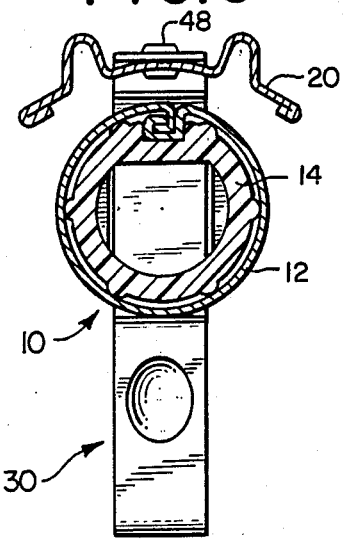
FIG. 6
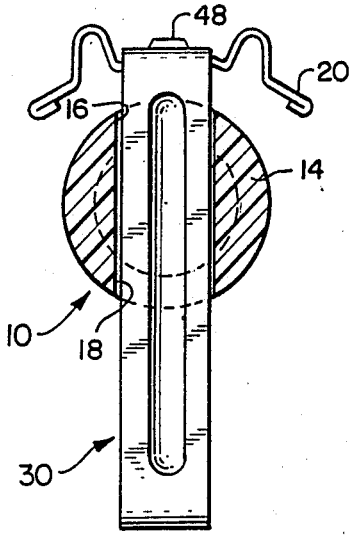
FIG. 4
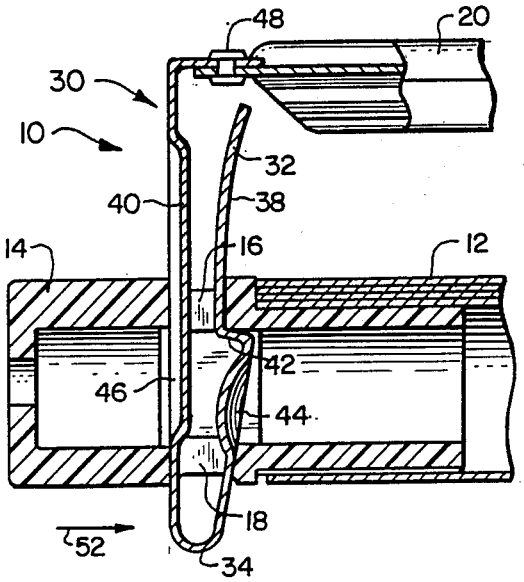
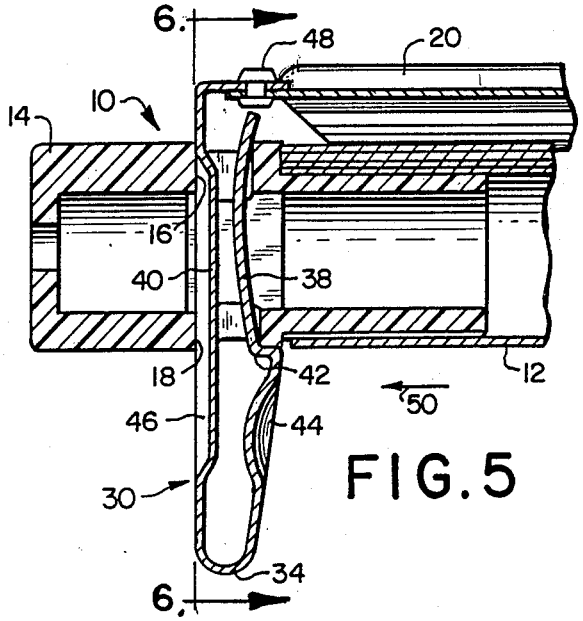
FIG. 5

FIG. 7
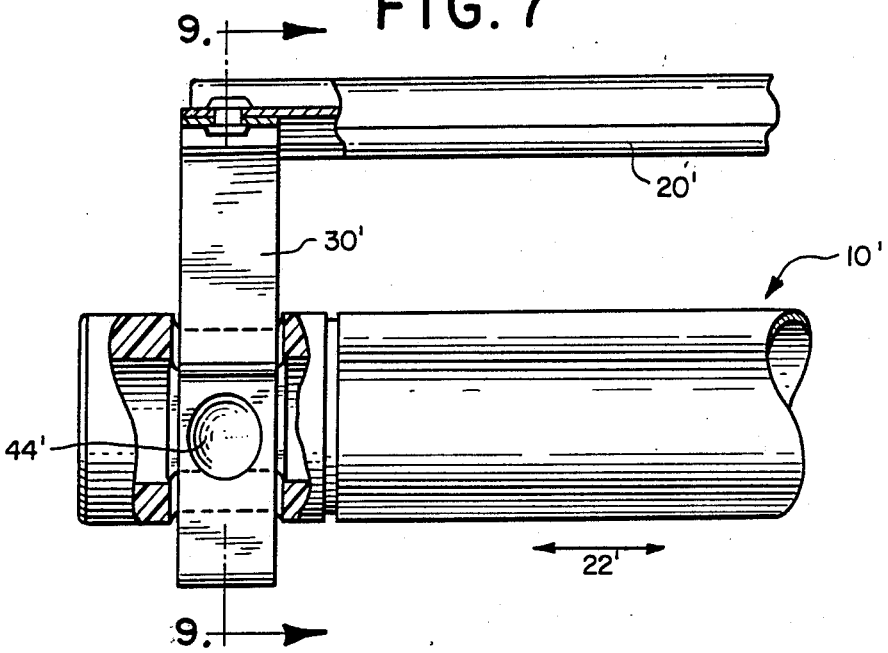
FIG. 8
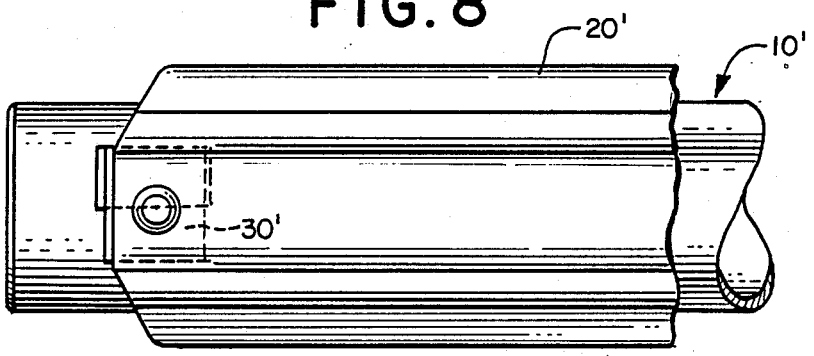
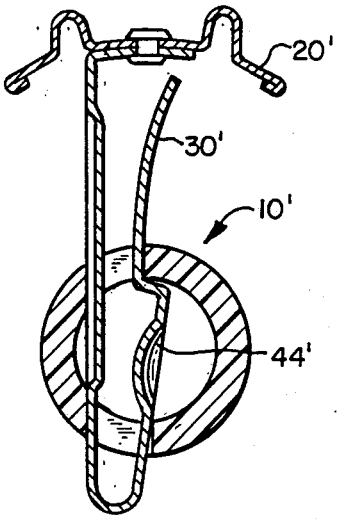
FIG. 9
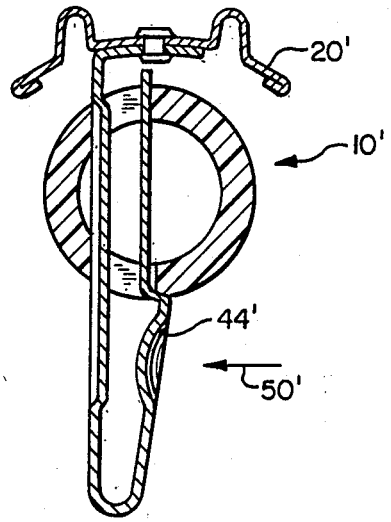
FIG. 10

GARMENT HANGER CADDY

BACKGROUND OF THE INVENTION

This invention relates to an improved caddy for garment hangers, and in particular to a hanger caddy with improved latching members.

Cameron U.S. Pat. No. 3,868,906 and Cameron U S. Pat. No. 4,340,145 (both assigned to the assignee of the present invention) disclose two prior art garment hanger caddies. These hanger caddies are used to organize and retain garment hangers for storage and shipment. They have met with considerable commercial success, and have found acceptance in a variety of businesses.

Hanger caddies of the type described in the Cameron patents include a tubular member and a relatively stiff retainer strip that is substantially coextensive with the tubular member. Two latching members are mounted to the retaining strip, one on either end, and the latching members releasably latch the retaining strip in a raised position (in which the retainer strip is spaced from the tubular member to allow garment hangers to be placed on the tubular member) and a lowered position (in which the retainer strip holds the garment hangers securely in place on the tubular member). It has been found that the detailed design of these latching members is critical to a successful product.

In particular, the latching member is subjected to outwardly directed forces when it is compressed for movement between the lowered and raised positions. These forces have in the past caused latching members to break, or to take a permanent bend. Furthermore, if the latching members are not sufficiently rigid, actuating forces are wasted in bending the entire latching member rather than in depressing the spring biased portion of the latching member.

However, increased stiffness of the latching member brings with it other disadvantages. This is because the latching member must actually be bent in a reverse direction when the retaining strip is completely removed from the tubular member. Thus, if the latching members are to be optimized they must be made stiff enough to reduce or eliminate the breakage and bending problems of the prior art, without becoming so stiff as to interfere with removal of the latching members from the tubular member.

Furthermore, in both of the Cameron patents discussed above the latching members are operated by applying manual forces along the longitudinal axis of the tubular member. This requires the user to insert his finger or thumb into the region between the garment hangers on the hanger caddy and the latching members. If the garment hangers are tightly packed on the hanger caddy, this can be difficult.

The present invention is directed to a hanger caddy having improved latching members that to a great extent overcome the prior art problems discussed above.

SUMMARY OF THE INVENTION

This invention relates to a garment hanger caddy of the type that comprises a stiff tubular member, a relatively stiff retainer strip substantially coextensive with the tubular member, and a pair of latching members, each secured to a respective end of the retainer strip and passing through a respective pair of openings in the tubular member to secure the retainer strip in first and second positions with respect to the tubular member.

According to a first feature of this invention, each of the latching members comprises a first section which defines an end portion and a latch step configured to engage the tubular member adjacent at least one of the openings to limit travel of the latching member, a second section which extends through a respective pair of openings, and means for securing a first end of the second section to the first section such that the first section is biased away from the second section. The second end of the second section is secured to the retainer strip, and means are positioned intermediate the first and second ends of the second section for stiffening the second section against bending away from the first section. The stiffening means is positioned centrally on the second section and is spaced away from the first end of the second section such that the second section is stiffer at a central portion thereof than at the first end.

As explained below, the stiffening means of this invention provides improved stiffness to the latching member, along with improved resistance to breaking and bending. At the same time, this stiffening means facilitates removal of the entire latching member from the tubular member when desired.

According to a second feature of this invention, a garment hanger caddy of the type described above is provided with a pair of latching members which include first and second sections and securing means as described above. In addition, each of the latching members defines an actuating axis extending between the first and second sections, and the tubular member defines a longitudinal axis. The actuating axes are each oriented transversely to the longitudinal axis such that a user can operate the latching members without inserting his fingers between the garment hangers on the garment hanger caddy and the latching members.

As explained below, this arrangement makes it easier for a user to operate the latching members when the garment hanger caddy is tightly packed with garment hangers.

The invention itself, together with further objects and attendant advantages, will best be understood by reference to the following detailed description, taken in conjunction with the accompanying drawings.

BRIEF DESCRIPTION OF THE DRAWINGS

FIG. 1 is an elevational view of a first preferred embodiment of the garment hanger caddy of this invention.

FIG. 2 is a perspective view of one of the latching members of FIG. 1.

FIG. 3 is a cross sectional view taken along line 3—3 of FIG. 1.

FIG. 4 is a fragmentary sectional view showing one of the latching members of FIG. 1 in a raised position.

FIG. 5 is a fragmentary sectional view showing one of the latching members of FIG. 1 in a lowered position.

FIG. 6 is a cross sectional view taken along line 6—6 of FIG. 5.

FIG. 7 is a partial elevational view in partial cutaway of a second preferred embodiment of the garment hanger caddy of this invention.

FIG. 8 is a top view of one end of the embodiment of FIG. 7.

FIG. 9 is a cross sectional view taken along line 9—9 of FIG. 7.

FIG. 10 is a cross sectional view in the plane of FIG. 9 showing the latching member in a lowered position.

DETAILED DESCRIPTION OF THE PRESENTLY PREFERRED EMBODIMENTS

Turning now to the drawings, FIGS. 1–6 show a first preferred embodiment 10 of the improved hanger caddy of this invention. The hanger caddy 10 includes a rigid metal tube 12 and a pair of molded plastic end caps 14. The end caps 14 are positioned in each of the ends of the tube 12, and each of the end caps 14 defines a respective upper opening 16 and lower opening 18. As shown in FIGS. 4–6, the two openings 16, 18 are co-linear and positioned on a diameter of the end cap 14. The caddy 10 also includes a rigid retainer strip 20 which is arranged parallel to and substantially coextensive with the tube 12. Reference numeral 22 is used in FIG. 1 to indicate a longitudinal axis which extends parallel to the axis of the tube 12.

The retainer strip 20 is held in position on the tube 12 by a pair of latching members 30. As best shown in FIG. 2, each of the latching members 30 is integrally formed from a one-piece strip of metal such as a suitable spring steel. Each of the latching members 30 defines a free end 32, a hinge portion 34, and a fixed end 36. In the following discussion the portion of the latching member 30 between the free end 32 and the hinge portion 34 will be referred to as the first section 38, and the portion between the hinge portion 34 and the fixed end 36 will be referred to as the second section 40. The first section 38 defines a latching step 42 and a depression 44 sized to receive the thumb of a user. The second section 40 defines an embossed ridge 46 that acts as a stiffening means and is positioned centrally on the second section 40 intermediate the two sides thereof. Furthermore, this embossed ridge 46 does not extend along the full length of the second section 40, but is rather spaced at a selected distance from the hinge portion 34. As explained below, this placement for the embossed ridge 46 makes the second section 40 stiffer at its center than adjacent the hinge portion 34. This provides operating advantages as described below. The fixed end 36 of each of the latching members 30 is secured to a respective end of the retainer strip 20 by suitable securing means such as a pop rivet 48 (FIG. 1).

As best shown in FIGS. 4 and 5, the latching step 42 is biased into engagement with the portion of the end cap 14 adjacent to at least one of the upper and lower openings 16, 18 by a spring force provided by the hinge portion 34. This biasing force biases the first section 38 away from the second section 40, and the biasing force can be overcome by manually applied forces applied to the first section 38 at the depression 44. Such actuating forces act to move the first section 38 toward the second section 40 along an actuating axis designated by reference numeral 50 (FIG. 5).

The latching members 30 hold the retainer strip 20 in either a raised position as shown in FIG. 4 or a lowered position as shown in FIG. 5. When the latching members 30 and the retainer strip 20 are in the lowered position as shown in FIG. 5, the latching step 42 engages the end caps 14 adjacent the lower opening 18. When in this position the embossed ridge 46 is positioned inside the lower opening 18.

When it is desired to raise the retainer strip 20 to the position of FIG. 4, the user applies actuating forces in the direction of the arrow 50 by placing his thumb on the depression 44 and pressing. The embossed ridge 46 prevents the second section 40 from bending in resistance to actuating forces applied in the direction of the arrow 50. This stiffening action provided by the embossed ridge 46 provides a number of advantages. First, it prevents the second section 40 from bending or breaking in use. Second, it ensures that substantially all of the energy applied by the user acts to move the latching step 42 toward its released position, thereby reducing the forces required to release the latching member 30.

Once the first section 38 has been depressed, the user then applies a slight upward motion to push the latching member 30 and the retainer strip 20 to the raised position shown in FIG. 4. The thumb depression 44 assists the user in applying this raising force, because the thumb of the user abuts against the upper side of the depression 44 to apply raising forces to the latching member 30.

Once the latching members 30 and the retainer strip 20 are in the raised position of FIG. 4, the latching step 42 engages a portion of the end caps 14 adjacent the upper opening 16 to limit travel of the latching member 30.

On occasion, it is necessary to remove the retainer strip 20 entirely from the tube 12. When this is desired, a user simply applies forces to the second section 40 along the direction of the arrow 52 in FIG. 4. Because the embossed ridge 46 does not extend into the lower opening 18 when the latching member 30 is in the raised position of FIG. 4, the second section 40 is free to bend to some extent in reaction to forces applied in the direction of the arrow 52. This bending compresses the first section 38 against the second section 40, coupled with pinching 38 & 40 together @ their 1st ends then pulling the latching mechanisms out of the plastic end caps thereby allowing the latching step 42 to pass through the upper opening 16 to release the retainer strip 20 from the tube 12. In order to facilitate this action, the free end 32 of the latching member 30 curves away from the second section 40. For this reason the free end 32 does not contact the second section 40 to resist the movement of the first section 38 required to release the latching step 42 from the upper opening 16.

The garment hanger caddy 10 utilizes latching members 30 which are oriented as in the Cameron patents described above with the actuating axes 50 parallel to the longitudinal axis 22. FIGS. 7–10 show portions of a second preferred embodiment 10′ of the caddy in this invention which utilizes latching members 30′ quite similar to the latching members 30 described above. The main difference is that the latching members 30′ are rotated 90° with respect to the position of the latching members 30 such that the actuating axes 50′ are oriented transversely to the longitudinal axis 22′ (FIGS. 7 and 10). This orientation for the latching members 30′ provides advantages in that the user no longer needs to interpose a thumb or finger between the latching member 30′ and hangers on the caddy 10′. Instead, since the actuating axes 50′ extend transversely to the longitudinal axis 22′, the user can simply apply a finger or thumb to the depressions 44′ to compress the latching members 30′ and move the retainer strip 20′ to the raised position.

The following details of construction are provided by way of illustration only in order to define the presently preferred embodiments of this invention in detail. In this embodiment the tube 12 is formed of electro-tin plated steel having a wall thickness of 0.018 inch and the end cap is molded from a thermoplastic such as ABS. The latching members 30, 30′ are formed of a steel such as Type C1050 having a thickness of 0.020 inch and a width of 0.50 inch. This steel is preferably heat treated to spring temper using the Aus-temper process. The final product has a hardness of 44–49 (Rockwell C). The latching members 30, 30' are finished with a black oxide finish followed by a layer of Carnuba wax to provide a uniform surface.

From the foregoing description it should be apparent that an improved hanger caddy has been described that provides a number of important advantages. First, the embossed ridge acts as a stiffening means to stiffen only desired portions of the latching member. In this way, the latching member is made stiffer where necessary to resist bending and provide easier operation. The latching member is nevertheless allowed to bend as necessary to remove the latching member entirely from the tube. Furthermore, the rotated position of the latching member with respect to the tube ensures that the user does not have to insert a finger between the garment hangers on the caddy and the latching member itself.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

We claim:

1. In a garment hanger caddy of the type comprising a stiff tubular member and a relatively stiff retainer strip substantially co-extensive with the tubular member, the improvement comprising:

a pair of latching members, each secured to a respective end of the retainer strip and passing through a respective pair of openings in the tubular member to secure the retainer strip in first and second positions with respect to the tubular member, each of said latching members comprising:

a first section which defines an end portion and a latch step configured to engage the tubular member adjacent at least one of the openings to limit travel of the latching member;

a second section which extends through the respective pair of openings;

means for securing a first end of the second section to the end portion of the first section such that the first section is biased away from the second section;

means for securing a second end of the second section to the retainer strip; and means, positioned on a portion of the second section intermediate the first and second ends, for stiffening the second section against bending away from the first section, said stiffening means positioned centrally on the second section and spaced away from the first end of the second section such that the second section is stiffer at a central portion thereof than at the first end.

2. The invention of claim 1 wherein the tubular member comprises a central tube and a pair of end caps, each mounted to a respective end of the tube, and wherein the openings are formed in the end caps.

3. The invention of claim 1 wherein each of the stiffening means comprises a ridge embossed in the second section.

4. The invention of claim 3 wherein each of the first sections defines a depression sized to receive a thumb of a user.

5. The invention of claim 1 wherein the first and second sections of each of the latching members is formed in one piece of a single integral strip of metal.

6. The invention of claim 1 wherein each of the latching members defines an actuating axis extending between the first and second sections, wherein the tubular member defines a longitudinal axis, and wherein the actuating axes are each oriented transversely to the longitudinal axis.

7. The invention of claim 1 wherein each of the latching members defines an actuating axis extending between the first and second sections, wherein the tubular member defines a longitudinal axis, and wherein the actuating axes are each oriented parallel to the longitudinal axis.

8. The invention of claim 1 wherein each of the first sections defines a free end opposite the end portion, and wherein the free ends curve away from the respective second sections.

9. In a garment hanger caddy of the type comprising a stiff tubular member and a relatively stiff retainer strip substantially co-extensive with the tubular member, the improvement comprising:

a pair of latching members, each formed from a single piece of metal that defines a free end, a fixed end secured to the retainer strip, and a hinge portion intermediate the two ends, the portion between the free end and the hinge portion forming a first section which defines a latching step, the portion between the hinge portion and the fixed end forming a second section;

each of said latching members passing through a respective pair of openings in the tubular member to secure the retainer strip in raised and lowered positions with respect to the tubular member, each pair of openings including a lower opening spaced from the retainer strip, said hinge portion biasing the latching step into engagement with the tubular member adjacent at least one of the openings;

each of said latching members defining an embossed ridge centrally positioned on a portion of the second section spaced from the hinge portion to stiffen only selected parts of the second section;

said ridges positioned within the lower openings when the latching members are in the lowered position to prevent the second sections from bending when the first sections are depressed to disengage the latching steps from the tubular member;

said ridges positioned out of the lower openings when the latching members are in the raised position to allow the second sections to bend as necessary to remove the latching members from the tubular member.

10. The invention of claim 9 wherein the tubular member comprises a central tube and a pair of end caps, each mounted to a respective end of the tube, and wherein the openings are formed in the end caps.

11. The invention of claim 9 wherein each of the first sections defines a depression sized to receive a thumb of a user.

12. The invention of claim 9 wherein each of the latching members defines an actuating axis extending between the first and second sections, wherein the tubular member defines a longitudinal axis, and wherein the actuating axes are each oriented transversely to the longitudinal axis.

13. The invention of claim 9 wherein each of the latching members defines an actuating axis extending between the first and second sections, wherein the tubular member defines a longitudinal axis, and wherein the actuating axes are each oriented parallel to the longitudinal axis.

14. The invention of claim 9 wherein each of the free ends curves away from the respective second section.

15. In a garment hanger caddy of the type comprising a stiff tubular member and a relatively stiff retainer strip substantially coextensive with the tubular member; the improvement comprising:

a pair of latching members, each secured to a respective end of the retainer strip and passing through a respective pair of openings in the tubular member to secure the retainer strip in first and second positions with respect to the tubular member, each of said latching members comprising:

a first section which defines an end portion and a latch step configured to engage the tubular member adjacent at least one of the openings to limit travel of the latching member;

a second section which extends through the respective pair of openings;

means for securing a first end of the second section to the end portion of the first section such that the first section is biased away from the second section; and means for securing a second end of the second section to the retainer strip;

each of said latching members defining an actuating axis extending between so as to pass through the first and second sections, the tubular member defining a longitudinal axis, and the actuating axes each oriented transversely to the longitudinal axis, said latching members adapted to receive an applied actuating force directed along the actuating axis to move the first and second sections together.

16. The invention of claim 15 wherein each of the first sections defines a espective free end opposite the end portion, and wherein each of the free ends curves away from the respective second section.

17. The invention of claim 15 wherein the tubular member comprises a central tube and a pair of end caps, each mounted to a respective end of the tube, and wherein the openings are formed in the end caps.

18. The invention of claim 15 wherein each of the first sections defines a respective depression sized to receive a thumb of a user.

19. The invention of claim 15 wherein the first and second sections of each of the latching members are formed in one piece of a single, integral strip of metal.

20. The invention of claim 15 wherein each of the latching members further comprises:

an embossed ridge formed in a central portion of the second section to stiffen the second section against bending away from the first section, said embossed ridge spaced away from the first end of the second section such that the second section is more flexible at the first end than at the central portion.

* * * * *